United States Patent [19]

Hoffmann

[11] Patent Number: 4,643,316

[45] Date of Patent: Feb. 17, 1987

[54] SORTING TRAY

[76] Inventor: Thomas M. Hoffmann, 1215 Andrew La., Santa Cruz, Calif. 95062

[21] Appl. No.: 679,396

[22] Filed: Dec. 7, 1984

[51] Int. Cl.[4] ..... B07C 7/00

[52] U.S. Cl. ..... 209/702; 206/373; 206/561; 209/614; 294/144; 414/675

[58] Field of Search ..... 209/614, 702, 703, 929, 209/942; 414/675; 220/20, 23.2, 339; 206/373, 561, 229, 230, 540, 526, 0.83, 0.84; 294/172, 265, 144; 232/1 R, 43.1; 133/8 R, 3 R, 1 R, 3 A; 221/92; 222/561, 124

[56] References Cited

U.S. PATENT DOCUMENTS

| | | | |
|---|---|---|---|
| D. 248,078 | 6/1978 | Warnekros | 414/675 |
| 2,664,224 | 12/1953 | Winneberger | 133/8 R |
| 2,731,270 | 1/1956 | Schulz | 206/561 |
| 3,255,894 | 6/1966 | Van Handel et al. | 414/675 |
| 3,747,756 | 7/1973 | Wheeler | 209/703 |
| 3,813,025 | 5/1974 | Solomon | 220/339 |
| 4,063,645 | 12/1977 | Canterman et al. | 209/702 |
| 4,261,683 | 4/1981 | Zaleon | 209/702 |
| 4,298,157 | 11/1981 | DeVierno | 209/702 |

*Primary Examiner*—David A. Scherbel
*Assistant Examiner*—Donald T. Hajec

[57] ABSTRACT

A sort tray characterized by two sorting sections hinged together along a common wall. The sorting sections, which are substantially mirror images of each other, can be folded together to allow compact storage of the sort tray. Sliding gates are provided at the mouths of the sorting sections to permit the contents of one of the sorting sections to be poured out without pouring out the contents of the other section.

13 Claims, 7 Drawing Figures

FIG-2-
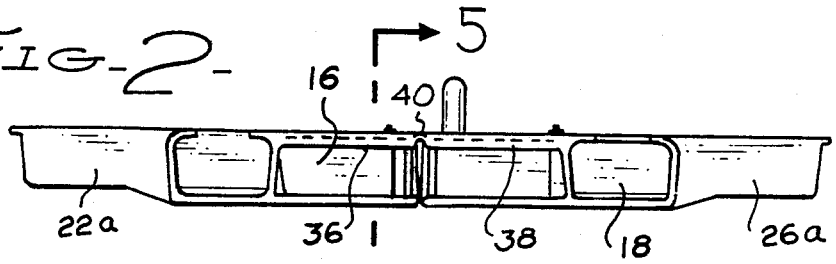
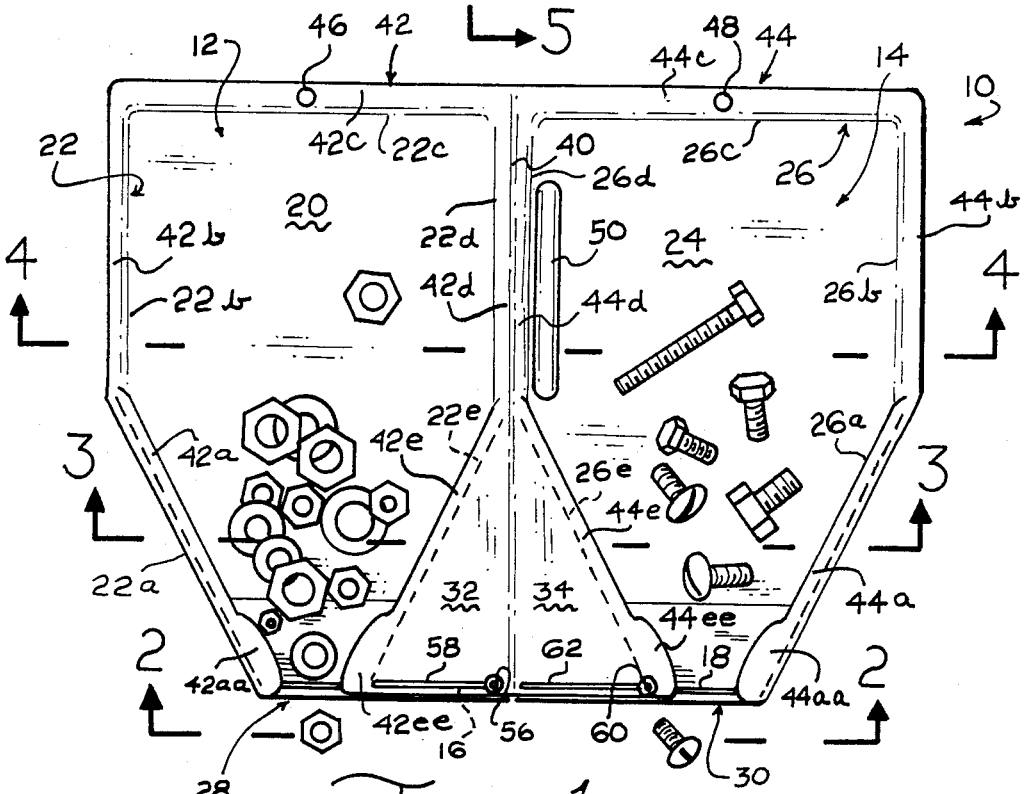
FIG-1-
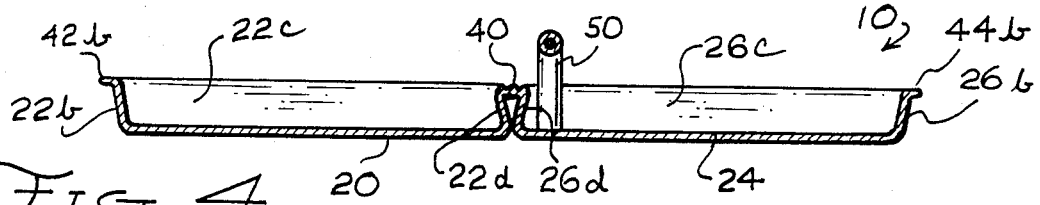
FIG-4-
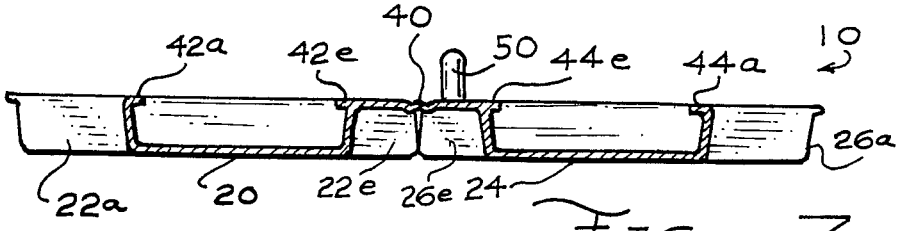
FIG-3-

SORTING TRAY

BACKGROUND OF THE INVENTION

1. Field of the Invention

This invention relates generally to trays, and more particularly to sorting trays for nuts, bolts, and the like.

2. Description of the Prior Art

The prior art discloses many types of trays useful for handling and sorting small objects. For example, U.S. Pat. No. 3,747,756 of Wheeler teaches a tray for depositing objects in a container which utilizes a generally planar member provided with a pouring and sorting surface. The surface has a pair of longitudinally extending, converging edges which converge on an opening or outlet. A sidewall structure encloses the surface and extends along the converging edges to form a pouring spout for directing objects to the opening. A lip projecting from beneath the plane of the member presents a supporting leg which holds one end of the member in an elevated position to facilitate the sorting of objects.

In U.S. Pat. No. 4,261,683 of Zaleon a tray for counting and sorting pills is disclosed including a housing having a bottom wall, two vertically opposed side walls, and a pair of arcuate shaped end walls. A divider extends between the two sidewalls of the housing to separate it into two individual compartments. Each compartment is provided with an oppositely facing pouring spout so that pills can be selectively removed from one compartment at a time.

In U.S. Pat. No. 2,507,792 of King a pill and capsule dispensing tray is disclosed including a trough shaped container having one open end and a movable wall which can divide the container into two sections. Pills are sorted from the closed section of the container to the open end of the container and then are poured into a pill container or box.

Problems that the prior art does not address in their entirety is how to provide a dual compartment sort tray for nuts, bolts, and the like which is simple in construction, easy to use, and compact.

SUMMARY OF THE INVENTION

An object of this invention is to provide a sort tray particularly adapted to sorting paired components, such as nuts and bolts.

Another object of this invention is to provide a sort tray which may be compactly stored.

A further object of this invention is to provide a sort tray wherein one group of sorted components can be poured out independently of another group of sorted components.

A still further object of this invention is to provide a sort tray of unitary design which is easy to manufacture and which is easy to use.

Briefly, the invention includes a pair of substantially identical sorting sections hinged together along a common wall. Each sorting section has continuous containment walls extending around a sorting surface which is provided with a gap or mouth through which components may be poured into a jar, can, or other suitable container. The mouth of each of these sorting sections can be selectively closed with a sliding gate. The hinge between the two sorting sections permits the sort tray to be folded in half for compact storage.

An advantage of this invention is that components such as nuts and bolts can be quickly separated from each other or matched with each other.

Another advantage of this invention is that sorted groups of components can be individually poured from sorting sections by opening an appropriate sliding gate.

Another advantage of this invention is that the sorted tray can be folded in half for compact storage.

These and other objects and advantages of the present invention will no doubt become apparent upon a reading of the following descriptions and a study of the several figures of the drawing.

BRIEF DESCRIPTION OF THE DRAWING

FIG. 1 is a top plan view of a sort tray in accordance with the present invention;

FIG. 2 is a front elevational view taken along line 2—2 of FIG. 1;

FIG. 3 is a cross sectional view taken along line 3—3 of FIG. 1;

FIG. 4 is a cross sectional view taken along line 4—4 of FIG. 1;

DETAILED DESCRIPTION OF THE PREFERRED EMBODIMENT(S)

Figure 5:
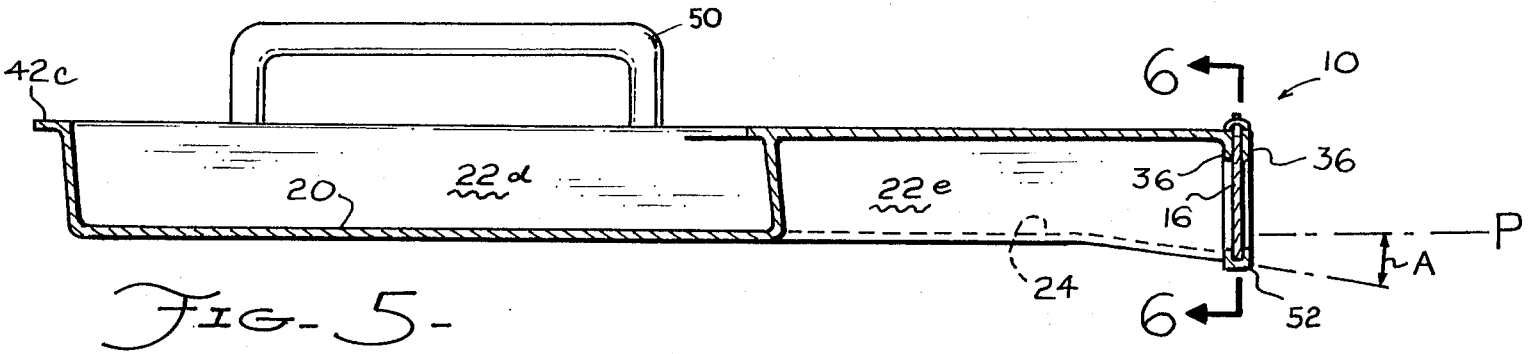
FIG. 5 is a cross sectional view taken along line 5—5 of FIG. 2.

Referring to FIGS. 1-6 in general and FIG. 1 in particular, a sort tray 10 includes a first sorting section 12, a second sorting section 14, and a pair of gates 16 and 18. Gate 16 is shown at its open position, and the gate 18 is shown in its closed position.

Sorting section 12 includes a sorting surface 20, and a contiguous containment wall 22 substantially surrounding sorting surface 20. Likewise, second sorting section 14 includes a sorting surface 24 substantially surrounded by a contiguous containment wall 26. For ease of description, portions of containment wall 22 will be labeled *22a, 22b, 22c, 22d,* and *22e,* while portions of containment wall 26 will be similarly labeled.

Wall portions *22b* and *22d* are substantially parallel to each other and are perpendicular to wall section *22c.* Wall sections *22a* and *22e* converge towards a gap 28 in containment wall 22 forming an opening or mouth for sorting section 12. Similarly, wall portions *26b* and *26d* are substantially parallel to each other and perpendicular to wall portion *26c,* and wall portions *26a* and *26e* converge towards a gap 30 which forms an opening or mouth for second sorting section 14.

A first triangularly shaped web 32 extends from the juncture between sorting section 12 and sorting section 14, and a second web 34 likewise extends from the juncture of the two sorting sections to wall portion *26e.* As best seen in FIG. 2, a first flange 36 extends downwardly from web 32 and a second flange 38 extends downwardly from the web 34. First sorting section 12 and second sorting section 14 are coupled together by a live hinge 40 which is provided between wall portions *22d* and *26d* and webs 32 and 34.

As best seen in FIG. 4, wall portions *22d* and *26d* are in abutment when sort tray 10 is in its open configuration. This abutment prevents sorting sections 12 and 14 from hinging downwardly, but will permit an upward hinging of the sorting sections.

As best seen in the cross sectional view of FIG. 5, an angled portion of sorting section 12 proximate to gap 28 extends downwardly at an acute angle A from the plane P of surface 20. A similar angled portion is provided in second sorting section 14 proximate to gap 30. These downwardly extending angled portions cause the remainder of the sorting sections to have a slight rearward tilt away from the angled portions when the sort tray is placed on a flat surface. The tilt prevents small, round components from rolling towards gaps 28 and 30 during sorting.

Containment wall 22 is provided with a contiguous lip 42, and containment wall 26 is provided with a contiguous lip 44. Lip 42 includes lip portions 42*a*–42*e*, and lip 44 includes lip portions 44*a*–44*e*. As best seen in FIG. 3, lip portions 42*a* and 42*e* extend inwardly over surface 20 and lip portions 44*a* and 44*e* extend inwardly over surface 24. In FIG. 4, lip portions 42*b* and 42*d* are shown extending outwardly and away from surface 20, and lip portions 44*d* and 26*d* are shown extending outwardly and away from surface 24. As seen in FIG. 5, lip 42*c* extends outwardly and away from surface 20. Similarly, lip 44*c* extends outwardly and away from surface 24.

As best seen in FIGS. 1, 2, 5, and 6, sections 42*aa* of lip 42*a* and 42*ee* of lip 42*e* flare upwardly and towards each other over gap 28, and sections 44*aa* of lip 44*a* and 44*ee* of lip 44*e* flare upwardly and towards each other over gap 30. These flared sections of the lip portions partially cover gap 28 to provide a better funnel through which components may be poured.

Lips 42*c* and 44*c* are provided with apertures 46 and 48, respectively, which align when the sort tray 10 is folded in half. A hook, nail, tang, or other suitable protrusion extending from a vertical wall surface can engage combined apertures 46/48 so that the folded sort tray may be easily stored.

A handle 50 is provided so that the open sort tray 10 can be easily moved around. Handle 50 is provided off-center so that there is no interference with the closing of the sort tray.

Figure 6:
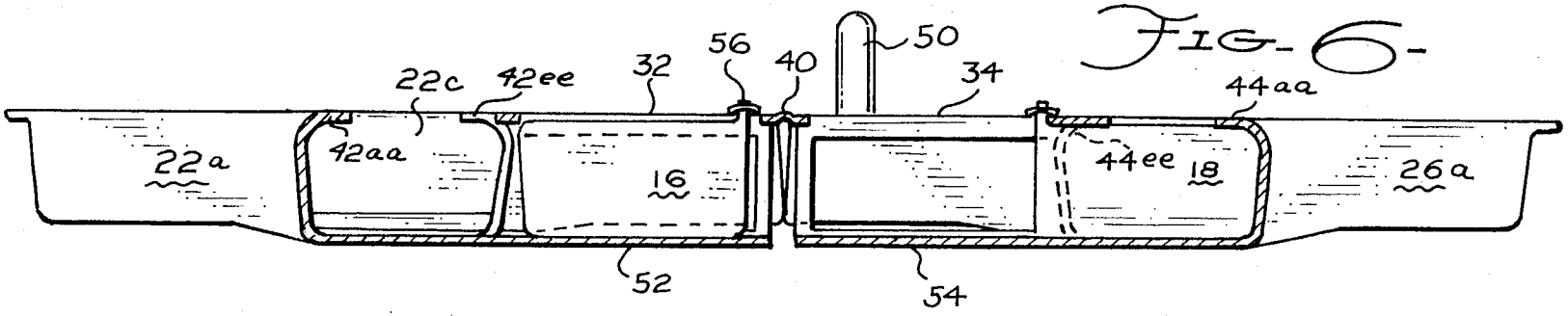
FIG. 6 is a cross sectional view taken along line 6—6 of FIG. 5.

As best seen in FIGS. 2, 5 and 6, walls 36 and 38 are provided with inwardly projecting flanges 52 and 54, respectively. The flanges are provided with grooves receptive to the lower edge of gates 16 and 18 to guide the gates. Likewise, grooves are formed across the sorting surface at gaps 28 and 30 to guide gates 16 and 18 across the gaps. Slots are provided in wall portions 22*e* and 26*e* to permit the gates 16 and 18 to slide across through those portions.

Gate 16 is provided with an upwardly extending knob portion 56 which is guided by a slot 58 of web 32. Similarly, gate 18 is provided with a knob portion 60 which is guided by a slot 62 of web portion 34. Knobs 56 and 60 are used to move sliding gates 16 and 18.

Figure 7:
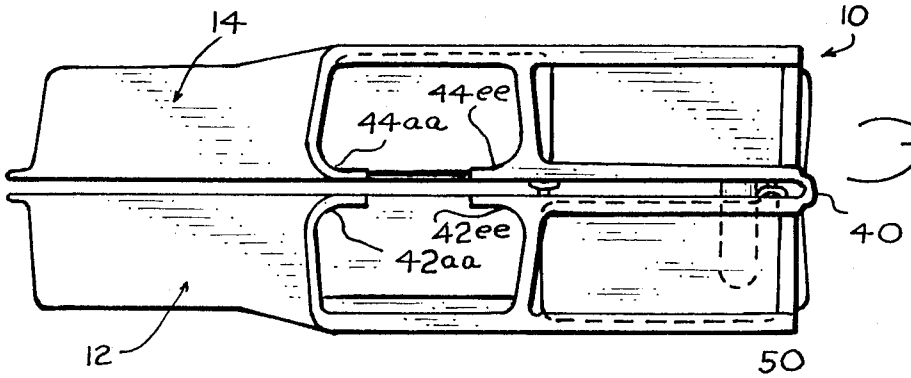
FIG. 7 is front elevational view illustrating the search and sort tray in its folded configuration.

With reference to FIG. 7, sorting section 14 can be folded over sorting section 12, or vice versa. When in the folded configuration, the sort tray 10 may be hung from a nail or hook as previously described.

In one type of use, the sort tray is placed flat on a surface as illustrated in the plan view of FIG. 1. A collection of paired components are dumped upon either sorting surface 20 or sorting surface 24, and then selected component are sorted onto the remaining sorting surface. For example, in FIG. 1, a number of nuts, bolts, screws, and washers were dumped onto sorting surface 20, and all of the bolts and screws were removed from sorting surface 20 to sorting surface 24. With gate 16 open, the nuts and washers can be poured into a convenient container, the bolts and screws remaining in second section 14. Gate 18 can be then opened to pour the bolts and screws into a separate container. After use, the device is folded in half for storage.

In another type of use, a container of nuts and washers may be poured upon sorting surface 20, and a container of bolts can be poured upon sorting surface 24. A matching nut, bolt, and washer can then quickly be obtained.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A sort tray comprising:

a first sorting section including a first sorting surface almost entirely surrounded by a first contiguous containment wall, said first containment wall being provided with a first gap proximate a forward edge of said first sorting section, wherein ends of said first contiguous containment wall angle together proximate said first gap to provide a first funnel, wherein a first angled portion of said first sorting section proximate said first gap extends downwardly from the plane of said first sorting surface, and wherein the portions of said first contiguous containment wall immediately proximate said first gap are flared upwardly and inwardly over said first gap to at least partially close said first funnel;

first gate means engaged with said first containment wall and adapted to selectively close said first gap;

a second sorting section coupled to said first sorting section, said second sorting section including a second sorting surface almost entirely surrounded by a second contiguous containment wall, said second contiguous containment wall being provided with a second gap proximate a forward edge of said second sorting section, wherein ends of said second continguous containment wall angle together proximate said second gap to provide a second funnel, wherein a second angled portion of said second sorting section proximate said second gap extends downwardly from the plane of said second sorting surface, and wherein the portions of said second contiguous containment wall immediately proximate said second gap are flared upwardly and inwardly over said second gap to at least partially close said second funnel; and second gate means engaged with said second containment wall and adapted to selectively close said second gap;

wherein said first sorting section and said second sorting section are integrally formed and are hinged together by a live hinge to permit the closure of said sort tray; and wherein one of said first sorting section and said second sorting section is provided with a handle positioned so as not to interfere with said closure of said sort tray.

2. A sort tray as recited in claim 1 wherein said first sorting section is provided with a first web between said live hinge and a first portion of said first containment wall proximate said first gap, and wherein said second sorting section is provided with a second web between said live hinge and a second portion of said second containment wall proximate said second gap.

3. A sort tray as recited in claim 2 wherein said first gate means includes a first sliding gate coupled to said first web and adapted to slide through an aperture in said first portion of said first containment wall to close said first gap, and wherein said second gate means includes a second sliding gate coupled to said second web and adapted to slide through an aperture in said second portion of said second containment wall to close said second gap.

4. A sort tray as recited in claim 3 further including first knob means attached to an upper portion of said first sliding gate and engaging a first slot provided in said first web, and second knob means attached to an upper portion of said second sliding gate and engaging a second slot provided in said second web.

5. A sort tray as recited in claim 4 further comprising a first guide groove extending across said first gap and adapted to engage a lower edge of said first sliding gate, and a second guide groove extending across said second gap and adapted to engage said second sliding gate.

6. A sort tray as recited in claim 5 wherein said first containment wall is provided with a first ridge having a first aperture, and wherein said second containment wall is provided with a second ridge having a second aperture, where said first aperture and said second aperture are in alignment when said sort tray is closed.

7. A sort tray comprising, a first sorting section including a first sorting surface almost entirely surrounded by a first contiguous containment wall, said first containment wall being provided with a first gap proximate a forward edge of said first sorting section, wherein ends of said first contiguous containment wall angle together proximate said first gap to provide a first funnel, and wherein a first angled portion of said first sorting section proximate said first gap extends downwardly from the plane of said first sorting surface at an acute angle relative said first sorting surface such that when said sort tray is placed on a planar surface said first angled portion inclines towards said first gap and the remainder of said first sorting section inclines away from said first angled portion;

first gate means engaged with said first containment wall and adapted to selectively close said first gap;

a second sorting section coupled to said first sorting section, said second sorting section including a second sorting surface almost entirely surrounded by a second contiguous containment wall, said second contiguous containment wall being provided with a second gap proximate a forward edge of said second sorting section, wherein ends of said second contiguous containment wall angle together proximate said second gap to provide a second funnel, and wherein a second angled portion of said second sorting section proximate said second gap extends downwardly from the plane of said second sorting surface at an acute angle relative said second sorting surface such that when said second sort tray is placed on a planar surface said second angled portion inclines towards said second gap and the remainder of said second sorting section inclines away from said second angled portion, second gate means engaged with said second containment wall and adapted to selectively close said second gap; and means provided at a juncture between said first and second sorting sections for attaching said first sorting section to said second sorting section said first sorting section and said second sorting section being integrally formed, wherein said first sorting section is provided with a first web between said juncture and a first portion of said first containment wall proximate said first gap, and wherein said second sorting section is provided with a second web between said juncture and a second portion of said second containment wall proximate said second gap.

8. A sort tray as recited in claim 7 wherein the portions of said first contiguous containment wall proximate said first gap are flared upwardly and inwardly over said first gap to at least partially close said first funnel, and wherein the portions of said second contiguous containment wall proximate said second gap are flared upwardly and inwardly over said second gap to at least partially close said second funnel.

9. A sort tray as recited in claim 7 wherein said first gate means includes a first sliding gate coupled to said first web and adapted to slide through an aperture in said first portion of said first containment wall to close said first gap, and wherein said second gate means includes a second sliding gate coupled to said second web and adapted to slide through an aperture in said second portion of said second containment wall to close said second gap.

10. A sort tray as recited in claim 9 further including first knob means attached to an upper portion of said first sliding gate and engaging a first slot provided in said first web, and second knob means attached to an upper portion of said second sliding gate and engaging a second slot provided in said second web.

11. A sort tray as recited in claim 10 further comprising a first guide groove extending across said first gap and adapted to engage a lower edge of said first sliding gate, and a second guide groove extending across said second gap and adapted to engage said second sliding gate.

12. A sort tray as recited in claim 11 wherein said first containment wall is provided with a first ridge having a first aperture, and wherein said second containment wall is provided with a second ridge having a second aperture, where said first aperture and said second aperture are in alignment when said sort tray is closed.

13. A sort tray comprising, a first sorting section including a first sorting surface almost entirely surrounded by a first contiguous containment wall, said first containment wall being provided with a first gap proximate a forward edge of said first sorting section, wherein ends of said first contiguous containment wall angle together proximate said first gap to provide a first funnel, and wherein a first angled portion of said first sorting section proximate said first gap extends downwardly from the plane of said first sorting surface at an acute angle relative said first sorting surface such that when said sort tray is placed on a planar surface said first angled portion inclines towards said first gap and the remainder of said first sorting section inclines away from said first angled portion;

first gate means engaged with said first containment wall and adapted to selectively close said first gap;

a second sorting section coupled to said first sorting section, said second sorting section including a second sorting surface almost entirely surrounded by a second contiguous containment wall, said second contiguous containment wall being provided with a second gap proximate a forward edge of said second sorting section, wherein ends of said second contiguous containment wall angle together proximate said second gap to provide a second funnel, and wherein a second angled portion of said second sorting section proximate said second gap extends downwardly from the plane of said second sorting surface at an acute angle relative said second sorting surface such that when said second sort tray is placed on a planar surface said second angled portion inclines towards said second gap and the remainder of said second sorting section inclines away from said second angled portion;

second gate means engaged with said second containment wall and adapted to selectively close said second gap; and hinge means attaching said first sorting section to said second sorting section for permitting closure of said sort tray, wherein one of said first sorting section and said second sorting section is provided with a handle positioned so as not to interfere with said closure of said sort tray.

* * * * *